US006062395A

United States Patent [19]

Oravetz et al.

[11] Patent Number: 6,062,395

[45] Date of Patent: May 16, 2000

[54] REVERSED CONTAINER END EJECTION SYSTEM

[75] Inventors: Keith D. Oravetz; Loyd J. Bridges, both of Oklahoma City, Okla.

[73] Assignee: Metal Container Corporation, St. Louis, Mo.

[21] Appl. No.: 09/160,906

[22] Filed: Sep. 25, 1998

[51] Int. Cl.[7] ..... B07C 5/00

[52] U.S. Cl. ..... 209/644; 209/606; 198/398; 198/395; 198/370.01; 198/370.11

[58] Field of Search ..... 209/597, 598, 209/606, 644; 198/395, 370.01, 370.11, 398

[56] References Cited

U.S. PATENT DOCUMENTS

| | | | |
|---|---|---|---|
| 4,386,708 | 6/1983 | Sieverin | 209/549 |
| 4,655,350 | 4/1987 | Mojden et al. | 209/577 |
| 4,977,998 | 12/1990 | Middeldorp | 198/395 |
| 5,145,050 | 9/1992 | Booher et al. | 198/395 |

*Primary Examiner*—Donald P. Walsh
*Assistant Examiner*—Jonathan R. Miller
*Attorney, Agent, or Firm*—Carr & Storm, L.L.P.

[57] ABSTRACT

A system (20) is provided for detecting and ejecting container ends having a reversed orientation from an axially aligned group of otherwise similar nested container ends having a non-reversed orientation. The system includes a support member (36) interposed along the path of movement of the container ends and having a bore (52) and an ejection slot (54). A counting sensor (62) for counting the number of passing container ends and a gap sensor (72) for detecting a gap in the periphery of the axially aligned group caused by a reversed container end are positioned upstream of the ejection slot and connected to a control unit (70). An air nozzle (82) is positioned next to the axially aligned group of container ends in axial alignment with, but laterally opposite to, the ejection slot and connected to a source of pressurized air controlled by the control unit (70). The control unit, upon receiving a signal from the gap detector, waits to receive a predetermined number of count signals from the counting sensor and then activates an air valve (88) releasing an air blast from the nozzle which impinges on the container ends aligned with ejection slot (54) causing reversed container ends to be ejected from the axially aligned group.

45 Claims, 4 Drawing Sheets

REVERSED CONTAINER END EJECTION SYSTEM

TECHNICAL FIELD OF THE INVENTION

The present invention relates generally to the detection and removal of articles having a first orientation from a conveyed arrangement of similar articles having a second, opposite orientation. In one aspect, it relates to the detection and ejection of container ends having a reversed orientation from an axially aligned group of nested container ends being otherwise similar but having a non-reversed orientation.

BACKGROUND OF THE INVENTION

A necessary component of the widely-used aluminum beverage can and similar cylindrical containers is the circular container end, sometimes called a "lid", which is seamed to the outermost edge of a cylindrical can body to form a fluid-tight container. Container ends are commonly formed from thin metal stock, for example aluminum or steel sheet, in a series of manufacturing operations. Typically, a circular blank is first cut from the metal stock. The blank is next formed into a shallow cup-shaped configuration having a generally flat center panel of circular shape, an annular countersink radius radially surrounding the center panel and extending axially (the axial direction being generally perpendicular to the center panel) below it, a seaming panel radially surrounding the countersink and extending axially above the center panel while also extending slightly radially outward, and a peripheral flange radially surrounding the seaming panel and extending radially outward. The peripheral flange is then curled downwardly at its peripheral edge to form a continuous lip suitable for later seaming to the container body.

In most production facilities, all of these initial operations are performed by an end-making machine, sometimes called a "shell press", having reciprocating die assemblies as is well known in the art. The resulting article, commonly called a "shell", can next be transferred to a liner machine (also well known in the art), which applies a sealing compound to the underside of the lip to improve sealing performance when the container end is seamed to the container body. At this point, the shell can be considered a finished container end for some applications, however, it is common for shells to be further processed to include an easy-opening feature such as a stay-on-tab opening or a ring-pull-tab opening. Shell-finishing machines, commonly called "conversion presses", are known in the art which utilize reciprocating die assemblies and other mechanisms to successively form contoured panels, score lines, rivets, and other features on the flat center panel of the shell and to form and attach accessories such as tabs or rings as necessary to produce the desired container end configuration. For purposes of this application, the term "end" will be used herein to refer to a shell, a finished container end with an easy-opening device, and all intermediate products in different stages of manufacture therebetween. In addition, when referring to the orientation of a container end, the terms "front" and "top" will be used interchangeably to denote the surface of the container end intended to face outwardly on an assembled container, while the terms "back" and "bottom" will be used to denote the surface of the container end intended to face inwardly on an assembled container.

Because of the slight outward inclination of the seaming panel and the axial offset between the center panel and the peripheral flange on each container end, a pair of such container ends which are oriented in the same axial direction can be "nested" one behind the other with the generally convex back portion of one container end projecting into the generally concave front portion of the other container end. Any number of like-oriented container ends can be nested together in this fashion. When nested, a container end is slidably engaged in the axial direction with respect to its immediate neighbors; however, it is mechanically interlocked in the lateral direction (the lateral direction being perpendicular to the axial direction) such that it is prevented from moving laterally independent of its neighbors. Nesting provides some significant advantages in the handling of container ends. In addition, nesting greatly decreases the volume occupied by a group of container ends. In some cases, nested container ends occupy less than about one-third of the volume occupied by a like amount of container ends which are not nested.

Bulk quantities of nestable container ends can be placed in an axially aligned group, sometimes called a "stick", which facilitates handling of the bulk container ends, both by manual means and by automated handling equipment. Sticks can be of any size, with some incorporating up to 660 lids each. Sticks of finished or semi-finished container ends can be taken from the production process at various points and placed in trays for short term storage or local transfer to other equipment. Alternatively, sticks of container ends can be packaged, typically in tubular paper bags, for long term storage or for shipment to A other facilities. These stored container ends can subsequently be used as infeed for further production operations by removing them from the packaging and introducing them into automated equipment such as conversion presses and canning equipment.

As axially aligned groups of container ends are subjected to handling, packaging and unpackaging, it is not uncommon for one or more of the container ends in such a group to be "flipped over" or reversed such that it has an orientation which is the opposite of that held by its neighbors. The axial surfaces of a reversed container end will match exactly with the axial surfaces of adjacent non-reversed container ends. As a consequence, the reversed container end or ends will no longer nest with the neighboring container ends. Since a reversed container end is not laterally interlocked with the adjacent container ends, then a axially aligned group of container ends incorporating one or more reversed container ends cannot withstand any significant shear forces and is much more likely to burst or fall apart during handling, causing the container ends to be scattered and disrupting production. Further, a reversed container end in an axially aligned group may eventually be fed into a piece of automated equipment, which can cause significant production losses as described below.

Container ends being fed into high-speed automated equipment (e.g., conversion presses) are often moved in continuous axial lines (i.e., an axial arrangement that is being constantly replenished at one point such that it can provide a continuous supply at another point) through tubular supply trackwork or conduits up to the point of introduction into the actual equipment. In some systems, the container ends being conveyed are urged through the trackwork by the force of gravity alone. In other systems, mechanical or pneumatic devices, sometimes called "pushers", are employed to maintain an axial force on the container ends to push them through the trackwork. This axial force exceeds 40 pounds in some systems. Even when pusher devices are employed, however, the lids in the conveyed line may not move smoothly or continuously through the trackwork. Instead, the lids are subject to intermittent surging caused by the operation of upstream and downstream equipment. During surges, the lids in the trackwork may temporarily stop, move forward suddenly, or even move backward a short distance. The container ends in this supply line are intended to be maintained in a common orientation (i.e., either the front side of all lids or the back side of all lids facing in the direction of conveyance) such that the container ends will feed into the subject equipment with a known orientation. However, a reversed container end which enters the supply conduit can be carried along by the remaining container ends even though it has the wrong orientation and is not nested.

The consequences of feeding an improperly oriented container end into automated equipment can range from simply spoiling the end in question to jamming or even damaging the equipment and/or its tooling. As a result, most container end supply lines include sensors and control systems which automatically shut down the supply line and associated equipment when a reversed end is detected. Plant personnel, alerted each time the equipment shuts down, then remove the reversed end from the supply line and restart the equipment.

Regardless of whether container end manufacturing equipment is shut down due to a reversed end which has jammed inside the mechanism, or merely due to the detection of a reversed end in the supply line, the down-time and product spoilage associated with clearing a reversed end and restarting the equipment can represent a significant loss of productivity. For example, a typical conversion press can produce 615 container ends per minute in each lane and can have up to three lanes. Each time a reverse-oriented container end caused the equipment to stop, then all three lanes will be shut down, sometimes for as much as 15 minutes, while the jam or reversed end is cleared and the machine is prepared for restarting. The 15 minutes of down time on a three-lane press operating at 615 ends per minute represents a loss of over 27,000 unproduced container ends. In addition, several dozen container ends will be spoiled as the conversion press comes up to its nominal speed. Further, operations of equipment upstream and downstream of the machine in question may also be disrupted. Accordingly, it is very desirable to remove reversed container ends from the conveyed line of ends in the supply conduit prior to the point of introduction into the actual processing equipment and without shutting down the associated equipment.

Systems for detecting and removing reversed container ends from a continuous flow of otherwise similarly aligned and nested container ends are known. For example, U.S. Pat. No. 4,977,998 discloses a system incorporating a coaxially mounted detector and ejector having a striker member which rapidly contacts a reversed end to cause its ejection from the flow of ends. U.S. Pat. No. 4,655,350 discloses a system incorporating an optical detector and an ejector having a striker member for contacting and ejecting a reversed container end from a moving line of ends. In such systems, however, the impact of the striker member, especially if it hits the peripheral flange of the end, can dent or otherwise deform the end, its flange and/or lip, thus making the end unsuitable for further use. This is especially true if the container ends are being held together with significant axial force such as is supplied by a pusher device. In such cases, the impact force of the striker member must be increased accordingly to overcome the friction between the container ends and achieve ejection. This increased striking force greatly increases the likelihood that the reversed container ends will be damaged by the striker during ejection. In addition, the striker must be precisely aligned with the reversed container end at the time of ejection to hit the right portion and to avoid striking and damaging a non-reversed end adjacent to the reversed end. Damaged non-reversed ends will not be ejected from the supply line and can cause production problems in a later operation, for example when the container end is seamed to a container body. A need therefore exists, for a reversed container end ejection system which does not rely on physical impact to eject the reversed ends. Further, a need exists for an ejection system which allows for some misalignment between the reversed container end and the ejector.

U.S. Pat. No. 5,145,050 discloses a system incorporating a hook member which engages the curled lip of a reversed container end and pulls it from the moving line or raises the reversed end in the line for removal by a secondary hook. While the disclosed system does not rely on direct impact to eject the reversed end, the extraction force exerted by the hook on the lip of the end may also damage or deform the container end so that it is no longer useable. This is especially true if the container ends are being held together with significant axial force by a pusher device as previously discussed. In such cases the hook will have to pull with a much greater force to remove or lift the reversed end. Further, if the force of the pusher is high enough, then the hook will merely pull through the curled edge of the lid without lifting or removing it. This will allow a damaged reversed container end to remain in the supply line. A need therefore exists for a reversed container end ejection system which does not directly contact any portion of the ends to be ejected. A need further exists for an ejection system which functions in the presence of significant axial forces on the line of ends.

As previously described, an axially aligned group of container ends being conveyed is subject to surges which can cause sudden stops, sudden forward movement or backward movement of the ends. In prior art reversed-end ejection systems, the sudden stop or reversal of the container ends can cause a striker member to miss its intended target, or can cause a hook member to become disengaged from the lip of a reversed end. In either case, the reversed container end may not be ejected, and either or both of the reversed container end and adjacent non-reversed container ends can be damaged. In addition, if the system uses a sensor to detect when the reversed container end is in position for ejection, then the sensor must recognize and account for backward motion of the container ends caused by surging. A need therefore exists, for a reversed container end ejector system which functions even in the presence of surges in the axially aligned group of container ends.

Further, several reversed container ends will occasionally be nested together within an axially aligned group forming a reversed sub-group. Prior reversed container end ejection systems involved the striking or hooking of the specific container ends to be ejected and do not provide for the ejection of a reversed sub-group comprising several reversed container ends nested together. A need therefore exists for a reversed container end ejection system which can eject a reversed sub-group comprising several reversed container ends.

SUMMARY OF THE INVENTION

A system is provided for ejecting container ends having a reversed orientation from a moving axially aligned group of otherwise similar container ends nested together in a non-reversed orientation. This system comprises a support member positioned along the path of movement of the axially aligned group of container ends. The support member constrains the axially aligned group to prevent lateral movement of the constituent container ends except when the container ends are positioned in a predetermined axial interval. The container ends within the interval are unconstrained by the support member in a preferred lateral direction. A counting sensor for counting the number of passing container ends and a gap sensor for detecting a gap in the periphery of the axially aligned group caused by a reversed container end are positioned upstream of the interval and connected to a control unit. An air nozzle is positioned next to the axially aligned group in alignment with the interval and connected to a source of pressurized air controlled by the control unit. The control unit, upon receiving a signal from the gap sensor, waits to receive a predetermined number of count signals from the counting sensor and then activates an air valve, releasing an air blast from the nozzle which impinges on the container ends within the interval causing reversed container ends therein to be ejected from the axially aligned group. The predetermined number of count signals corresponds to the number of container ends which pass the counting sensor as a gap in the axially aligned group moves from a position adjacent the gap sensor into the axial interval.

In another embodiment of the current invention, the support member comprises a generally tubular conduit having a wall defining a bore, an ejection slot, and an air passage. The bore passes longitudinally through the conduit and forms a portion of the path of movement for the axially aligned group. The ejection slot is formed through the wall transversely across a portion of the bore with axial edges positioned at the upstream and downstream container ends of the axial interval. The air passage is formed through the wall between the air nozzle and the bore allowing an air blast exiting the nozzle to pass through the air passage into the bore.

In yet another embodiment, the system further comprises an ejected end sensor positioned adjacent to the expected path of ejected container ends for detecting whether or not a container end has been ejected from the axially aligned group and providing a corresponding signal to the control unit.

In a still further embodiment, the system also comprises a secondary gap detector positioned along the path of movement for detecting a peripheral gap in the axially aligned group of container ends downstream of the axial interval and providing a corresponding signal to the control unit.

In another embodiment, a system is provided which does not require a counting sensor. The gap sensor is positioned to detect a gap when it is in a location corresponding to a reversed container end being aligned with the predetermined axial interval. The control unit, upon receiving a gap detected signal from the gap sensor, releases an air blast to eject the reversed container end.

In another aspect of the current invention, methods for ejecting reversed container ends from an axially aligned group of nested non-reversed container ends are provided. Several embodiments of this aspect are provided, including one for use with a container end ejection apparatus having a counting sensor, and one for use with an apparatus which does not have a counting sensor.

BRIEF DESCRIPTION OF THE DRAWINGS

A more complete understanding of the invention and its advantages will be apparent from the following detailed description when taken in conjunction with the accompanying drawings in which.

DETAILED DESCRIPTION OF THE INVENTION

Figure 1:
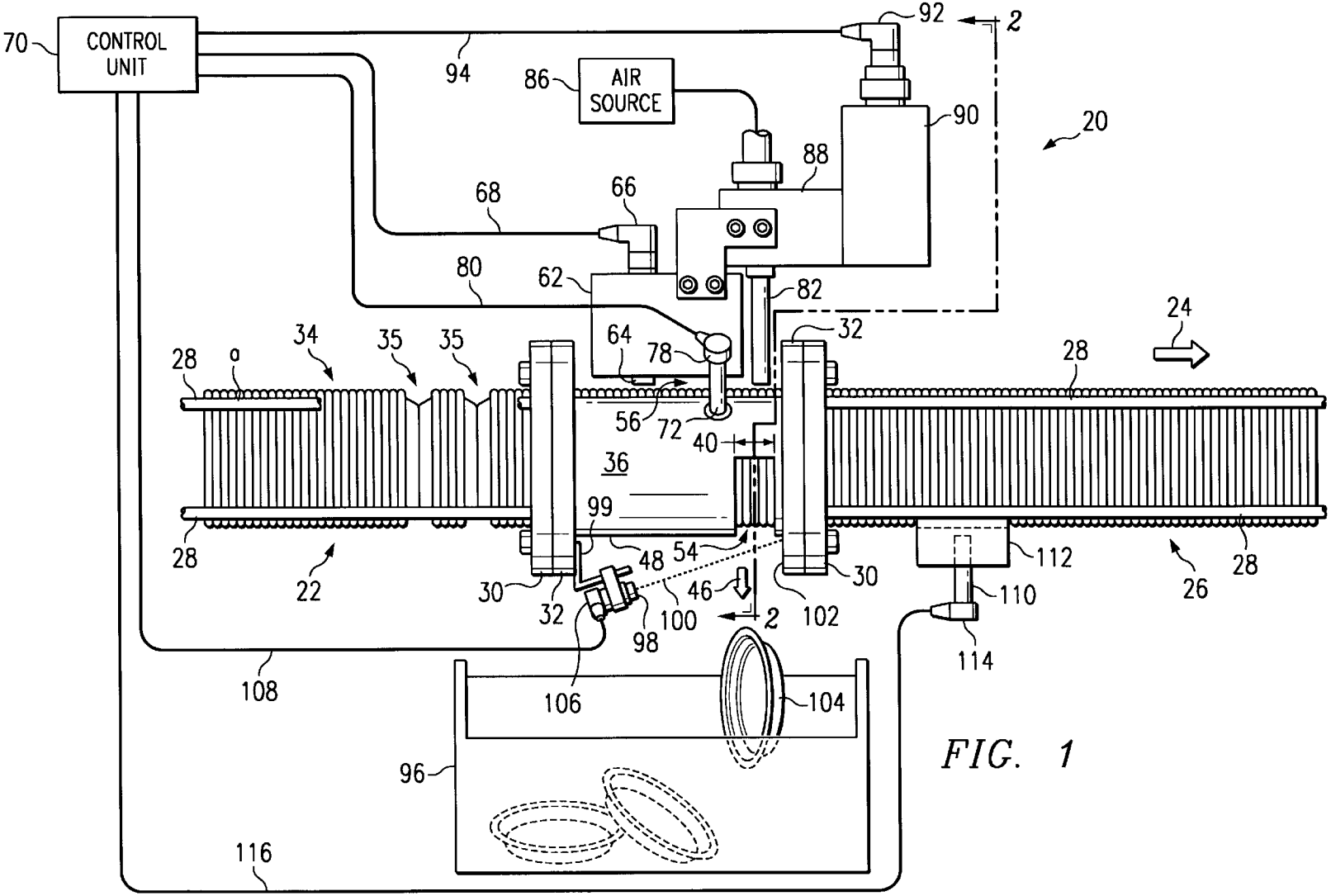
FIG. 1 is a side elevation view of a reversed container end ejection system in accordance with one aspect of the current invention.

Referring now to the drawings wherein like referenced characters designate like or corresponding parts throughout several views, a preferred embodiment of the reversed container end ejection system of the present invention is illustrated.

Referring to FIG. 1, a system for ejecting container ends having a reversed orientation from a moving axially aligned group of otherwise similar container ends nested together in a non-reversed orientation is indicated generally by reference numeral 20. In the embodiment shown, the axially aligned group of nestable container ends, indicated generally by reference numeral 22, is conveyed in a direction of movement, indicated by arrow 24, along a path of movement defined by trackwork 26. In the embodiment shown, the trackwork 26 comprises a plurality of rails 28 supported in a concentric arrangement around the path of movement by ring-shaped flanges 30 having a central passage through which the container ends can pass. For purposes of illustration, one of the rails 28 (designated with reference letter a in FIG. 1) is shown with a portion broken away to more clearly show the container ends being conveyed. The axially aligned group of container ends 22 forms an evenly ridged peripheral surface, denoted generally by reference numeral 34, when the container ends are all similarly oriented. The presence of a reversed container end, however, forms a gap 35 in the periphery of the axially aligned group of container ends 22 where the oppositely facing surfaces of the adjacent container ends abut. Two peripheral gaps 35 are shown in FIG. 1, indicating that at least two reversed container ends are present in the portion of the axially aligned group 22 positioned upstream of ejection system 20.

Referring still to FIG. 1, the ejection system 20 is seen to include a support member 36 positioned along the path of movement and adapted to allow the axially aligned group of container ends 22 to move axially therethrough. In the embodiment shown, support member 36 includes mounting flanges 32 which can be bolted to trackwork flanges 30 such that system 20 can be conveniently interposed along the path of movement defined by the trackwork 26. It will be readily apparent, however, that the system 20 can be adapted for attachment to other types of trackwork known in the art, for example tubular conduits or troughs, without departing from the scope of the current invention.

Figure 2:
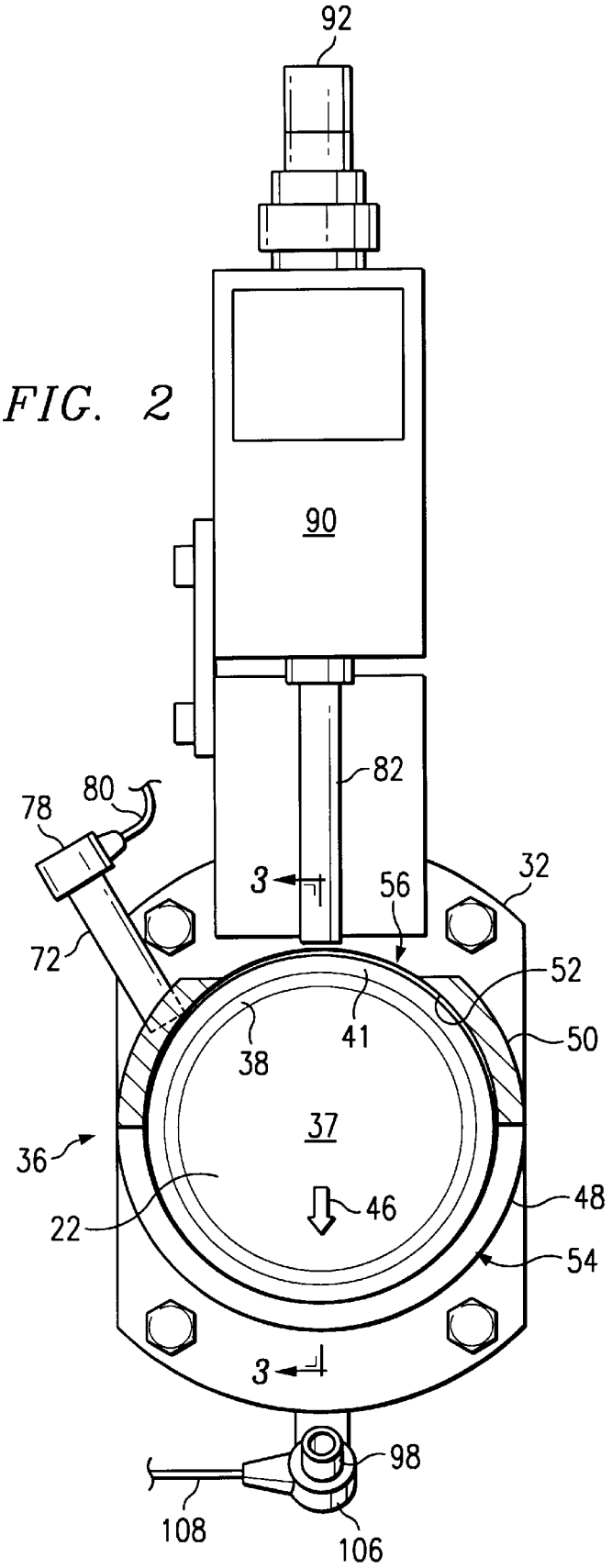
FIG. 2 is an enlarged sectional view thereof taken generally along line 2—2 of FIG. 1.
Figure 3:
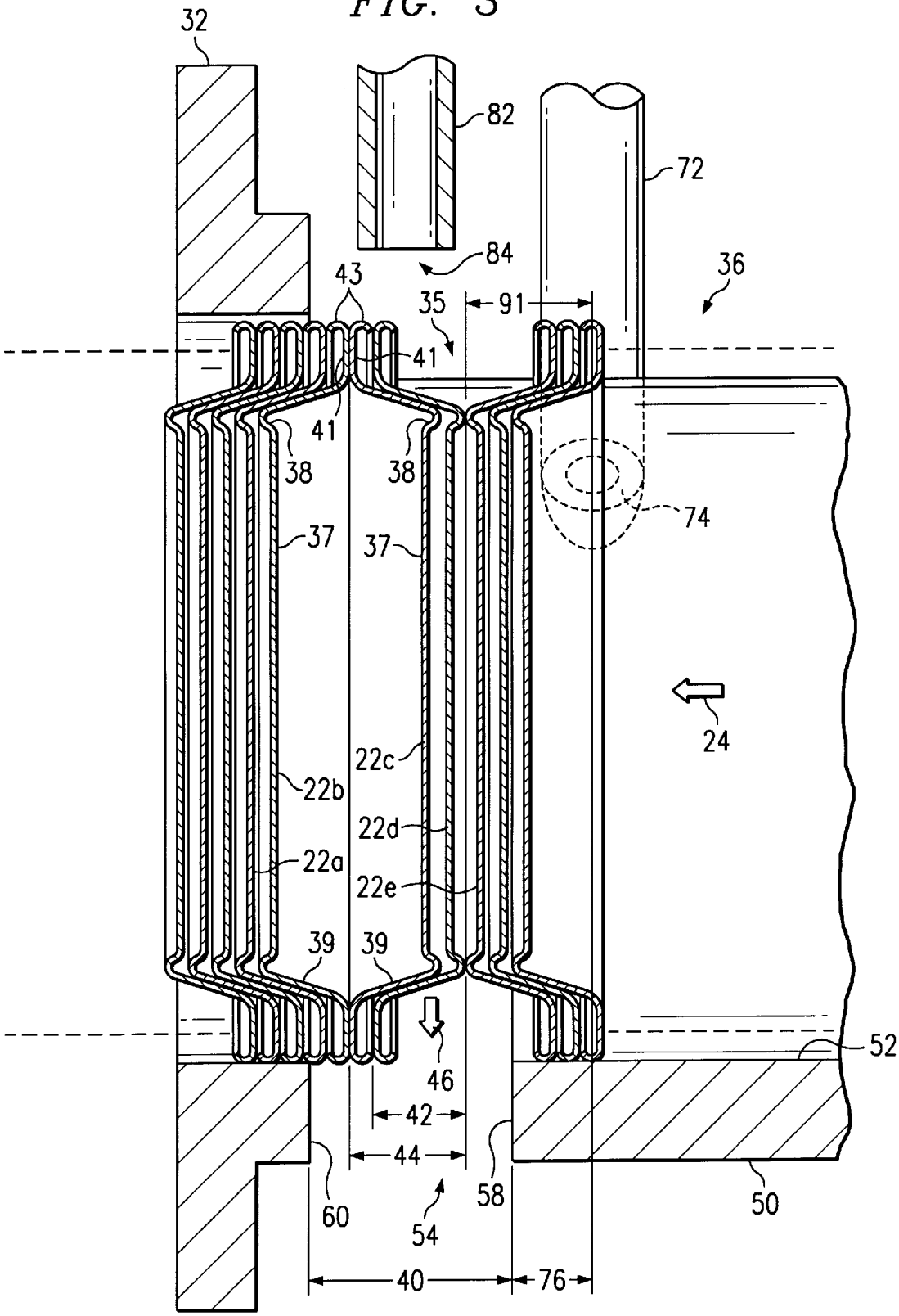
FIG. 3 is an enlarged partial sectional view thereof taken generally along line 3—3 of the FIG. 2.

Referring now also to FIGS. 2–3, additional views of the system 20 are shown. FIG. 2 is a cross section through support member 36 and axially aligned group of container ends 22 viewed in the axial direction (i.e., along the longitudinal axis of the axially aligned group 22). FIG. 3 is a partial cross section through support member 36 and axially aligned group of container ends 22 viewed in a lateral direction (i.e., perpendicular to the axial direction). Note that the selection of views results in the direction of movement 24 of axially aligned group 22 being from left to right in FIG. 1 and from right to left in FIG. 3.

FIG. 3 also illustrates the characteristic features of a typical container end which were previously described, including a generally flat center panel 37, an annular countersink radius 38, a seaming panel 39, a peripheral flange 41, and a curled lip 43. FIG. 3 clearly illustrates how the inclined seaming panels 39 allow the nesting of like-oriented container ends, for example container ends 22*a* and 22*b*. FIG. 3 also illustrates how unlike-oriented container ends do not nest, but instead will merely abut along the junction between the peripheral flanges 41 (for example container ends 22*b* and 22*c*), or between the countersink radii 38 (for example container ends 22*d* and 22*e*)

The support member 36 is adapted to constrain the axially aligned group of container ends 22 to prevent lateral movement (the lateral direction being generally perpendicular to the long axis of the axially aligned group and hence also perpendicular to the path of movement) of the constituent container ends in the group, except when the container ends are in a predetermined axial interval, denoted by reference numeral 40. As best seen in FIG. 3, the interval 40 has an axial dimension at least as great as the axial dimension of one container end, this dimension being denoted by reference numeral 42. In preferred embodiments of the current invention, the interval 40 has an axial dimension greater than the axial dimension of several nested container ends. For example, two nested reversed container ends 22*c* and 22*d* are shown in FIG. 3. The axial dimension of container end 22*d* is denoted by reference numeral 42, while the axial dimension of the sub-group having the two container ends 22*c* and 22*d* is denoted by reference numeral 44. It will be readily apparent that the axial dimension 44 of the sub-group containing two container ends is considerably less than two times the axial dimension 42 of a single container end, due to the nested configuration of the container ends in the sub-group. The container ends of the axially aligned group 22 within the interval 40 are unconstrained by the support member 36 in a preferred lateral direction, indicated by the arrow denoted by reference numeral 46.

In the preferred embodiment shown in FIGS. 1–3, the support member 36 comprises a generally tubular conduit 48 having a wall 50 defining a bore 52, an ejection slot 54, and an air passage 56. The bore 52 passes longitudinally through the conduit 48 and comprises a portion of the path of movement for the axially aligned group of container ends 22. It will be noted that the longitudinal axis of the bore 52 is generally coincident with the axial dimension of the axially aligned group of container ends 22. As best seen in FIG. 2, the wall 50 of conduit 48 constrains the axially aligned group of container ends 22 from lateral movement except in the axial interval 40. The ejection slot 54 is formed through wall 50 and cuts transversely across the bore 52 such that the axially aligned group of container ends 22 is not laterally constrained in the preferred lateral direction 46. As best seen in FIG. 3, the ejection slot 54 has a first edge 58 axially positioned at the upstream end of the interval 40 and a second edge 60 axially positioned at the downstream end of the interval 40. The ejection slot 54 is dimensioned to allow the passage therethrough of at least one container end moving from the bore 52 in the preferred lateral direction 46 to the exterior of the conduit 48. In a more preferred embodiment, the ejection slot is dimensioned to allow the passage therethrough of at least four container ends moving from the bore 52 in the preferred lateral direction 46 to the exterior of the conduit 48. The air passage 56 is formed through the wall 50 into the bore 52. A portion of the air passage 56 is in axial alignment with the interval 40 and laterally opposite to the ejection slot 54.

As best seen in FIG. 1, the system 20 also includes a counting sensor 62 positioned along the path of movement for counting the number of constituent container ends of the axially aligned group 22 passing by a first sensed point and producing count signals corresponding to the net number of container ends which have passed. The first sensed point is located upstream, relative to the direction of movement, from the interval 40, and corresponds generally to the location of a sensor head 64. The count signals produced by the counting sensor 62 are transmitted through an electrical connector 66 and line 68 to a control unit 70 for further processing. The counting sensor 62 can detect both the passing and the direction of passage of the container ends, the count can be incremented for container ends passing in the downstream direction and decremented for any container ends passing in the upstream direction. In this way, a net count of the container ends passing the sensed point can be accurately maintained even if the axially aligned group of container ends 22 repeatedly surges back and forth past the sensor head 64. In the preferred embodiment, the counting sensor is an optical device manufactured by Sencon with Part Number 11-391-66SS; however, it will be readily apparent that other sensors known in the art could be used to sense the passage and direction of passing of the container ends without departing from the scope of the current invention.

The system 20 also includes a gap sensor 72 positioned along the path of movement for detecting a peripheral gap 35 in the ridged surface of the axially aligned group 22 indicating the presence of a reversed container end. The gap sensor 72 provides a gap detected signal to the control unit 70 when the gap 35 passes a second sensed point. The second sensed point corresponds generally to the location of the sensor head 74 of the gap detector 72. The sensor head 74 is located a predetermined distance, denoted by reference numeral 76 (FIG. 3), upstream of the axial interval 40. In the preferred embodiment, the sensor head 74 of the gap sensor 72 is located a predetermined distance (again shown by reference numeral 76) upstream from ejection slot 54. The gap detected signal produced by the gap sensor 72 is transmitted through electrical connector 78 and line 80 to the control unit 70 for further processing.

In the preferred embodiment, the gap sensor 72 is a device of the type which generates a localized electric field extending across the radial periphery of the axially aligned group of container ends 22. The electric field fluctuates whenever a peripheral gap in the axially aligned group (caused by a reversed container end) moves through it. This fluctuation causes a detectable change in the signals produced by the device which is interpretable as a gap detected signal. It will, of course, be readily apparent that other devices known in the art for detecting gaps between objects could be used for the gap detector 72. For example, magnetic proximity sensors, optical detectors, and mechanical switches can be used without departing from the scope of the current invention.

The system 20 also includes an air nozzle 82 forming an air outlet 84 and being operatively connected to a pressurized air source 86. The nozzle 82 is positioned such that the air outlet 84 is adjacent to the axially aligned group of container ends 22 and in axial alignment with the interval 40. The nozzle 82 is oriented such that an air blast leaving the air outlet 84 is directed against the container ends 22 in the preferred lateral direction 46. In the preferred embodiment, the air nozzle 82 is positioned such that an air blast leaving the air outlet 84 can pass through the air passage 56 formed in the wall 50 of the support member 36.

An air valve 88 is operatively connected between the air nozzle 82 and the air source 86 for controlling a flow of pressurized air from the air source to the air nozzle in response to signals received from the control unit 70. In the preferred embodiment, the air valve 88 is a solenoid operated air valve of the type well known in the art. The air valve 88 is operably connected to control solenoid 90 which receives control signals through electrical connector 92 and line 94 from the control unit 70.

Figure 4:
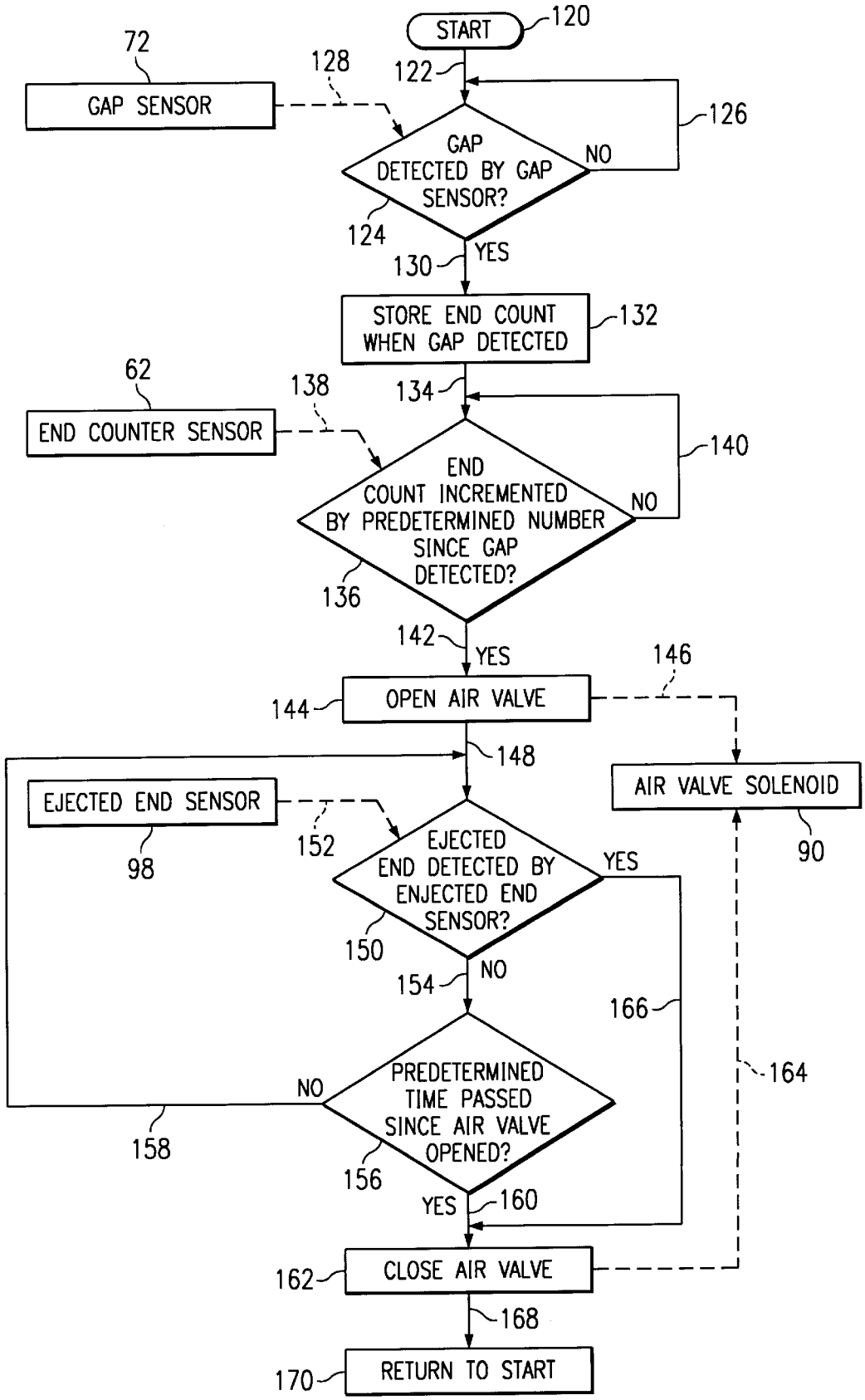
FIG. 4 is a schematic diagram of the control process of the invention.

Referring now also to FIG. 4, the control unit 70 processes incoming control signals received from the counting sensor 62 and the gap sensor 72 and produces outgoing control signals, for example to the solenoid 90 controlling the air valve 88, as necessary to eject any reversed container ends detected in the axially aligned group of container ends 22. In particular, the control unit 70 begins the ejection process upon receiving a gap detected signal from the gap sensor 72. Once the gap detected signal is received, the control unit 70 waits to receive a predetermined number of count signals from the counting sensor 62. The predetermined number of count signals generally corresponds to the net number of container ends which must pass by the first sensed point (e.g., the sensor head 64 of the counting sensor 62) as a peripheral gap 35 in the axially aligned group moves from the second sensed point (e.g., the sensor head 74 of the gap sensor 72) into the interval 40. In FIG. 3, for example, this movement is shown by arrow 91. After receiving the predetermined number of count signals, the control unit 70 then activates the air valve 88 to release a flow of pressurized air from the pressurized air source 86 into the air nozzle 82. The pressurized air exits the nozzle 82 through the air outlet 84 as an air blast directed in the preferred lateral direction 46 against the group of container ends 22. The impingement of the air blast on the container ends located in the axial interval 40 produces a force sufficient to overcome the friction at the junction between the reversed container ends and the non-reversed container ends but insufficient to overcome the support provided to the non-reversed container ends by adjacent nested container ends. Since the container ends in the interval 40 are not constrained against movement in the preferred lateral direction 46, this force causes the reversed container ends to be ejected from the axially aligned group.

For example, in the preferred embodiment shown in FIG. 3, a first group of non-reversed container ends including container ends 22*a* and 22*b* are followed by a reversed sub-group having two reversed container ends 22*c* and 22*d* which, in turn, are followed by a second group of non-reversed container ends including is container end 22*e*. Note that in FIG. 3, additional container ends positioned upstream and downstream of the ten container ends shown have been omitted for purposes of illustration, and are instead represented by dashed lines. To allow ejection, the junction between unlike-oriented container ends, i.e., between ends 22*b* and 22*c* and between ends 22*d* and 22*e*, must be positioned within the axial interval 40 defined by the ejection slot 54. Although the support member 36 does not constrain the movement of the container ends 22*a*–22*e* in the preferred lateral direction 46 when they are aligned with the ejection slot 54, the container ends will nonetheless remain laterally aligned in the absence of significant lateral forces. This is because the non-reversed container ends (e.g., 22*a*, 22*b*, 22*e*) are laterally interlocked with adjacent container ends extending into the unsupported interval 40 from the supported portion of the path, and the reversed container ends (e.g., 22*c*, 22*d*) are held in place by frictional force at the leading and trailing junctions with the non-reversed container ends. The distance 91 between the position of the peripheral gap 35 when detected by the sensor head 74 and the position which the peripheral gap must occupy in order to place the associated reversed container ends at the center of the ejection slot 54, can then be calculated on the basis of lid counts, i.e., the number of nested lids which must pass a given point for the axially aligned group of container ends 22 to advance the desired distance. This predetermined number of lid counts corresponding to the desired distance 91 is programmed into the control unit 70 such that once a gap is detected, the control unit will wait until the gap has advanced into the predetermined position within the ejection slot before activating the air blast. The impingement of the air blast on container ends 22*a*–22*e* is sufficient to overcome the interface friction at the junctions between unlike container ends but is insufficient to overcome the mechanical support provided by the nested container ends. The reversed container ends 22*c* and 22*d* thereby slip out of the axially aligned group in the preferred lateral direction 46 and fall into container 96 (FIG. 1) for reuse or recycling. As the reversed container ends are ejected from the axially aligned group of container ends 22, the remaining non-reversed container ends are impelled across the resulting gap by the continuous axial force present on the axially aligned group of container ends. Thus, in FIG. 3, container end 22*e* would move to nest with end 22*b* as soon as reversed ends 22*c* and 22*d* are ejected.

It will be readily apparent that, because an air blast is used to remove the reversed container ends from the axially aligned group rather than the impact of a striker or a hook, the ejected container ends are not damaged and can be recycled for use. In addition, the unejected non-reversed container ends are not damaged by the air blast.

In the preferred embodiment, an air nozzle 82 having an air outlet 84 about ⅜ inches in diameter and an air source with a pressure within the range of about 80 to about 100 psig has been found to satisfactorily eject reversed container ends from an axially aligned group of container ends subjected to an axial pressure within the range of about 30 pounds to about 40 pounds. An air blast having a duration within the range of about 0.4 seconds to about 0.5 seconds has been found satisfactory for the ejection of single reversed container ends. It will, of course, be readily apparent that the air nozzle size, air pressure and duration of the air blast may be varied from the values described above depending upon the axial pressure exerted on the axially aligned group.

A significant advantage of the current invention is that it will eject multiple nested reversed container ends, also called reversed sub-groups. Multiple nested reversed container ends are extremely difficult to detect because the peripheral gap indicating a reversed container end appears at only one end of a reversed sub-group. In other words, several nested reversed container ends will have an outward appearance that is identical to a single reversed container end. However, in the current invention the reversed container ends need not be precisely aligned with the air nozzle 82 in order to be ejected when the air blast is activated. Rather, all reversed container ends positioned within the axial interval 40 defined by the ejection slot 54 will be ejected when the air blast is activated. Thus, increasing the axial width of the ejection slot 54 to accommodate the passage of multiple nested container ends will allow the ejection of multiple nested reversed container ends. In the preferred embodiment, an ejection slot having an axial dimension within the range of about ⅜ inches to about ⅝ inches has been found satisfactory. An ejection slot having a width of about ⅝ inches will allow the ejection of up to four nested reversed container ends at one time. If the ejection slot becomes too large, however, then the air blast may cause the nested non-reversed container ends in the interval 40 to buckle or be blown through the ejection slot rather than closing the gap.

In another embodiment of the current invention, the reversed container end ejection system 20 further comprises an ejected end sensor 98 positioned adjacent the expected path for container ends ejected from the system. The ejected end sensor 98 detects whether or not a container end has been ejected from the axially aligned group of container ends 22 and provides a corresponding signal to the control unit 70. In the preferred embodiment, the ejected end sensor 98 comprises an optical sensor comprising both a light source and a light detector. The sensor 98 can be attached to the support member 36 using a bracket 99 such that a light beam, denoted by reference numerals 100, produced by the light source is directed just outside the ejection slot 54 along the expected path of an ejected container end. A small quantity of reflective material 102 is provided on mounting flange 32 for reflecting a portion of light beam 100 back towards the light detector of sensor 98. When an ejected container end (such as that shown by reference numeral 104) passes through light beam 100, the sensor 98 will produce a end ejected signal which is transmitted through electrical connector 106 and line 108 to the control unit 70. Upon receiving an end ejected signal, the control unit 70 can activate the air valve 88 to stop the flow of pressurized air from air source 86 to air nozzle 82. In this way, the air blast will be terminated as soon as the reversed container end is ejected from the axially aligned group, rather than allowing the air blast to continue for a fixed duration. This variable duration air blast reduces the amount of pressurized air required to operate the system 20. Alternatively, the control unit 70 can be programmed to open air valve 88 for a fixed period of time or until the ejected end detected signal is received from the sensor 98, whichever comes first. When using this control method, the default duration of the air blast can be set to a relatively long period, for example, within the range from 1.5 seconds to 2.0 seconds, thereby increasing the possibility that tightly held reversed container ends will be ejected. This increased default duration for the air blast would not result in significantly increased overall air usage, however, because in the typical ejection cycle the air blast would be cut off when the ejected container end was detected by sensor 98 at a time significantly before the end of the default time period.

In the preferred embodiment of the system 20, the control unit 70 also stores data relating to the signals received from the counting sensor 62, the gap sensor 72, and the ejected end sensor 98. This data can be analyzed to prepare statistical data useful in the evaluation and analysis of the manufacturing operation. For example, data on the reversed container end rate (i.e., number of reversed container ends per 1,000 container ends), reversed container end ejection rate (i.e., number of reverse container ends ejected compared to reverse container ends detected) can be collected. In actual operation, embodiments of the current invention similar to the preferred embodiment described above have produced reversed container end ejection rates within the range of 95 to 96 percent.

As previously described, it is extremely important that reversed container ends be prevented from reaching the infeed of automated production equipment. Since no reversed container end ejection system can guarantee a reversed container end ejection rate of 100 percent, the preferred embodiment of the current invention also includes a secondary gap sensor 110 positioned along the path of movement for detecting a peripheral gap in the periphery of the axially aligned group of container ends 22 downstream of the ejection slot 54. The secondary gap sensor 110 is mounted on trackwork 26 using a mounting block 112 or other suitable mounting structure. When the secondary gap sensor 110 detects a gap in the axially aligned group of container ends 22, a gap detected signal is transmitted through electrical connector 114 and line 116 to the control unit 70. Upon receiving a gap detected signal from the secondary gap sensor 110, the control unit 70 initiates actions to prevent the reversed container end that has been detected from entering the process equipment. In the preferred embodiment, the control unit activates an alarm and suspends movement of the line of container ends 22 when a gap is detected by secondary gap sensor 110. The alarm in the preferred embodiment is a flashing light, but other alarms including audible devices, vibrating devices, and written notices (e.g., print-outs) can be used. This allows maintenance personnel to manually remove the reversed container end from the line before it can reach the production equipment. Any of the sensor types described for use as gap sensor 72 can also be used for secondary gap sensor 110 and will not be further discussed.

The reversed end ejection system previously described constitutes a first embodiment of the current invention, one which is particularly suited to handling container ends which are subject to significant surging back and forth as they are conveyed through the trackwork. In situations where surging of the container ends is less pronounced, an alternative embodiment of the current invention can be utilized. This alternative embodiment (not shown) is similar in appearance and in most details to the original embodiment shown in FIGS. 1–3, however, a counting sensor is not required and the control unit 70 is modified accordingly.

A reversed-end ejector system 20 according to the alternative embodiment includes a support member 36, gap sensor 72, air nozzle 82, air valve 88, and control unit 70. Unless otherwise described, each component of this embodiment is essentially identical to the like-numbered components previously described. The gap sensor 72 is positioned along the path of movement such that it will detect a gap 35 in the periphery of an axially aligned group of container ends 22 when the gap is at a predetermined position corresponding to a reversed container end being located within the axial interval 40 (e.g., as shown in FIG. 3). It will be readily apparent that the gap sensor 72 for this alternative embodiment will be located downstream from the position shown in FIG. 1. When a gap is detected by the gap detector 72, a gap detected signal is sent to the control unit 70. Upon receiving the gap detected signal, the control unit 70 of this alternative embodiment actuates the air valve 88 to release a flow of pressurized air from the air source 86 to the air nozzle 82 to eject the reversed container end. Note that in this embodiment, the control unit 70 does not wait for count signals since a counting sensor is not required. The duration of the air blast can be a pre-determined period or it can be controlled by a signal from an ejected end sensor 98 as previously described.

Referring now to FIG. 4, another aspect of the current invention is a method for ejecting reversed container ends from a moving axial line of nested non-reversed container ends. It will be understood that the method of the current invention includes providing an appropriate end-conveying and ejecting apparatus such as the reversed container end ejection system 20 previously described. The method shown in FIG. 4 can be implemented through the control unit 70, which can be either a programmable device or a hard-wired controller.

FIG. 4 illustrates a flow diagram showing the process steps of a first embodiment of this aspect, namely a process for use with an end ejection system as shown in FIGS. 1–3 that includes a counting sensor. Certain of the process steps require input from the sensors of the system 20, such as the gap sensor 72, the counting sensor 62, and the ejected lid sensor 98. These sensors are shown schematically in FIG. 4 using the same reference numerals used in FIGS. 1–3, and with the resulting control signals represented by dashed lines.

The process of the current invention can be conveniently described starting at block 120, however, it will be appreciated that the process is continuous and therefore can be described beginning at any intermediate point. From start block 120, the process moves along path 122 to block 124. The block 124 represents a test or decision process in which the controller unit 70 ascertains whether a gap has been detected by the gap sensor 72. If no gap has been detected by the gap sensor 72, then the process follows path 126 back to path 122. This path represents the idle state of the system 20 when no reversed container end has been detected. If, on the other hand, the gap sensor 72 has detected a gap in the periphery of the axially aligned group 22, then a gap detected signal, denoted by dashed line 128, will be supplied to the control system 70 and the decision block 124 will route the process through path 130 to the process represented by block 132.

The block 132 represents a process in which the current container end count at the time the gap is detected is stored in a register or memory location. After the process shown in block 132, the process is routed along path 134 to another decision process or test shown in block 136. The block 136 represents a process in which the controller ascertains whether the count of container ends passing the counting sensor 62 has been incremented by a predetermined amount since the gap was detected. This can be performed by comparing the current container end count to the count stored in block 132. As previously discussed, the predetermined number used by decision process 136 is the number of container ends which must pass the counting sensor 62 in order for a gap to move from the gap sensor 72 to the desired position within the ejection slot 54. Count signals supplied to the control unit 70 by the counting sensor 62 are represented by dashed line 138. If the lid count has not been incremented by the predetermined amount, then the process is routed through path 140 back to path 134, representing a wait state for system 20 as the sensed gap moves into a position aligned with the ejection slot 54. As previously discussed, since the counting sensor 62 can detect both the passing and the direction of passage of container ends, the count signals 138 supplied to the process in block 136 will represent net container ends passing the counting sensor, and multiple passes of the same container end caused by a back and forth motion of the axially aligned group of container ends will not cause an error in the count. It will, of course, be appreciated that the processes shown in blocks 132 and 136 could be modified slightly to obtain the same result, for example, by re-setting a count register to zero in block 132 and then testing the value of that register against the predetermined number in block 136.

Once the process in block 136 determines that the lid count had been incremented by a predetermined number since the gap was detected, the process is routed along path 142 to block 144. In the block 144, the control unit 70 opens the air valve 88 by activating the air valve solenoid 90 using a signal represented by dashed line 146. The opening of air valve 88 by air valve solenoid 90 allows pressurized air from source 86 to flow through nozzle 82 and out air opening 84 where it will impinge on the container ends aligned with ejection slot 54. The lids aligned with ejection slot 54 will include the reversed container ends detected by the gap sensor 72 (due to the resulting peripheral gap) and whose position was indirectly monitored by the counting sensor 62. The air blast will cause the reversed container ends aligned with ejection slot 54 to be ejected from the line of container ends as previously described. After opening the air valve in the process step 144, the process proceeds along path 148 to another decision process or test shown in block 150. In the process 150, the control unit 70 determines whether it has received a signal, denoted by dashed line 152, from the ejected end sensor 98. If no ejected container end is detected, the process is routed along path 154 to another decision process or test shown in block 156. In the decision block 156, the control unit 70 determines whether a predetermined time has passed since the air valve was opened. As previously discussed, the predetermined time can be selected to maximize the possibility that tightly held reversed container ends will be ejected. If the predetermined time has not passed, then the process will be routed along path 158 back to path 148 so that the two tests shown in blocks 150 and 156 can be repeated. If, on the other hand, the predetermined time has passed since the air valve was opened, the process is routed along path 160 to the process shown in block 162. In the process shown in block 162, the control unit 70 closes air valve 88 by sending a signal, denoted by dashed line 164, to air valve solenoid 90. Similarly, if the decision process in block 150 determines that an ejected container end has been detected, then the process is routed through paths 166 and 160 to block 162, initiating the close air valve command. Once the air valve has been closed, as shown in process block 162, the ejection cycle has been completed and the process is now routed along path 168 to block 170. The block 170 represents the return of the process to its starting point at block 120 and the repeat of the process cycle just described.

The control signals received from the secondary gap sensor 110 are not shown in FIG. 4 since the control unit 70 does not use these signals to control the ejection of reversed container ends. Rather, the control unit 70, upon receiving a gap detected signal from sensor 110, initiates an alarm, line shut-down, or other process as necessary to prevent reversed container ends from proceeding further downstream.

Yet another embodiment of the current invention is a method for ejecting reversed container ends for use with an end ejector system that does not include a counting sensor. This process (not shown) can be implemented using a reversed end ejection system in which the gap sensor 72 is positioned such that a gap is detected when a reversed end is located in alignment with the ejection slot 54. The process of the current invention is similar to that shown in FIG. 4, however, blocks 62, 132 and 136 are not present and path 130 connects directly to path 142. The remaining process steps are essentially as described for the previous embodiment.

Thus, there are disclosed systems and methods for detecting and ejecting reversed container ends from an axially aligned group of nested non-reversed container ends that overcome the shortcomings and disadvantages of the prior art in ejection system. While the foregoing embodiments of the invention have been disclosed with reference to specific system structures, it is to be understood that many changes in detail may be made as a matter of design choices, without departing from the spirit and scope of the invention, as defined by the appended claims.

We claim:

1. A system for ejecting container ends having a reversed orientation from an axially aligned group of nestable container ends being otherwise similar but having a non-reversed orientation, said axially aligned group moving axially along a path of movement in a direction of movement, wherein a reversed container end creates a peripheral gap in the otherwise evenly ridged radial periphery of said axially aligned group, said system comprising:

a support member positioned along said path of movement and adapted to allow said axially aligned group to move axially therethrough while constraining said axially aligned group to prevent lateral movement of said container ends except when said container ends are located in a predetermined axial interval, said interval having an axial dimension at least as great as the axial dimension of one said container end, said container ends within said interval being unconstrained by said support member in a preferred lateral direction;

a counting sensor positioned along said path of movement for counting the number of said container ends passing a first point and providing count signals to a control unit indicating the number of said container ends passing said first point, said first point being located upstream, relative to the direction of movement, from said interval;

a gap sensor positioned along said path of movement for detecting a peripheral gap in said radial periphery of said axially aligned group indicative of a reversed container end passing a second point and providing a gap detected signal to said control unit, said second point being located upstream and at a predetermined distance from said axial interval;

an air nozzle operatively connected to a pressurized air source and forming an air outlet, said nozzle being positioned such that said air outlet is adjacent said axially aligned group and in alignment with said axial interval, and said nozzle being oriented such that an air blast leaving said air outlet is directed against said axially aligned group in said preferred lateral direction;

an air valve operatively connected between said nozzle and said air source for controlling a flow of pressurized air from said air source to said nozzle in response to signals received from the control unit;

said control unit, upon receiving said gap detected signal from said gap sensor, waiting to receive a predetermined number of count signals from said counting sensor, said predetermined number of count signals generally corresponding to the number of container ends which pass the first point as a peripheral gap in the axially aligned group moves from said second point into said interval, said control unit then actuating said air valve to release a flow of pressurized air from said pressurized air source into said nozzle; and said pressurized air exiting said nozzle through said air outlet as an air blast directed in said preferred lateral direction against said container ends, the impingement of said air blast on said container ends in said axial interval producing a force sufficient to overcome the friction between said reversed container ends and said non-reversed container ends but insufficient to overcome the support provided to said non-reversed container ends by adjacent nested container ends, thereby ejected said reversed container ends from said axially aligned group.

2. The system of claim 1, wherein said counting sensor can detect the passing and the direction of passage of container ends passing the first sensed point.

3. The system of claim 1, wherein said axial dimension of said interval is greater than the axial dimension of four said container ends nested together.

4. The system of claim 1, wherein said support member comprises a generally tubular conduit having a wall defining a bore, an ejection slot and an air passage;

said bore passing longitudinally through said conduit and comprising a portion of said path of movement for said axially aligned group;

said ejection slot formed through said wall and transversely crossing across a portion of said bore, having a first edge axially positioned at the upstream end of the interval and a second edge axially positioned at the downstream end of the interval, and being positioned, when viewed in cross section along said bore, on the side of said wall opposite said air nozzle, said ejection slot accommodating the passage therethrough of at least one said container end moving from said bore in the preferred lateral direction; and said air passage formed through said wall between said nozzle and said bore allowing an air blast exiting said nozzle to pass therethrough into said bore.

5. The system of claim 4, wherein said ejection slot is sized to allow passage of more than one nested container end simultaneously therethrough.

6. The system of claim 4, wherein said ejection slot has an axial dimension within the range of about ⅜ inches to about ⅝ inches.

7. The system of claim 4, wherein said ejection slot is adapted to allow lateral passage of a sub-group of container ends therethrough.

8. The system of claim 7, wherein the number of container ends in said sub-group is within the range of one to four.

9. The system of claim 1, wherein an optical sensor is used for counting said container ends passing said first point.

10. The system of claim 1, wherein a sensor sensing fluctuations in a localized electric field is used for detecting said peripheral gap passing said second point.

11. The system of claim 1, wherein a sensor sensing fluctuations in a localized magnetic field is used for detecting said peripheral gap passing said second point.

12. The system of claim 1, wherein an optical sensor is used for detecting'said peripheral gap passing said second point.

13. The system of claim 1, wherein a mechanical sensor is used for detecting said peripheral gap passing said second point.

14. The system of claim 1, further comprising:

an ejected end sensor positioned adjacent an expected path for said container ends ejected from said system for detecting whether or not a container end has been ejected from said axially aligned group and providing a corresponding signal to said control unit.

15. The system of claim 14, wherein an optical sensor is used for said ejected end sensor.

16. The system of claim 15, wherein said optical sensor includes a light source producing a light beam directed across the expected path of said ejected container end and a light receiver detecting said light beam and providing an end ejected control signal to said control unit upon interruption of said light beam by the passage of an ejected container end thereacross.

17. The system of claim 14, wherein said control unit, upon receiving an end ejected signal, actuates said air control valve to stop the flow of pressurized air from said air source to said nozzle.

18. The system of claim 1, further comprising:

a secondary gap sensor positioned along said path of movement for detecting a peripheral gap in said radial periphery of said axially aligned group indicative of a reversed container end passing a third point and providing a secondary gap detected signal to said control unit, said third point being located downstream of said interval.

19. The system of claim 18, wherein said control unit, upon receiving said secondary gap detected signal, produces an alarm signal.

20. The system of claim 18, wherein a sensor sensing fluctuations in a localized electric field is used for detecting said peripheral gap passing said third point.

21. A system for ejecting container ends having a reversed orientation from an axially aligned group of nestable container ends being otherwise similar but having a non-reversed orientation, said axially aligned group moving axially along a path of movement in a direction of movement, wherein a reversed container end creates a peripheral gap in the otherwise evenly ridged radial periphery of said axially aligned group, said system comprising:

a support member positioned along said path of movement and adapted to allow said axially aligned group to move axially therethrough while constraining said axially aligned group to prevent lateral movement of said container ends except when said container ends are located in a predetermined axial interval, said interval having an axial dimension at least as great as the axial dimension of one said container end, said container ends within said interval being unconstrained by said support member in a preferred lateral direction;

a gap sensor positioned along said path of movement for detecting a peripheral gap in said radial periphery of said axially aligned group when said gap is at a predetermined position corresponding to a reversed container end being located within said axial interval, said gap sensor providing a gap detected signal to said control unit when said gap is detected at said predetermined position;

an air nozzle operatively connected to a pressurized air source and forming an air outlet, said nozzle being positioned such that said air outlet is adjacent said axially aligned group and in alignment with said axial interval, and said nozzle being oriented such that an air blast leaving said air outlet is directed against said axially aligned group in said preferred lateral direction;

an air valve operatively connected between said nozzle and said air source for controlling a flow of pressurized air from said air source to said nozzle in response to signals received from the control unit;

said control unit, upon receiving said gap detected signal from said gap sensor, then actuating said air valve to release a flow of pressurized air from said pressurized air source into said nozzle; and said pressurized air exiting said nozzle through said air outlet as an air blast directed in said preferred lateral direction against said container ends, the impingement of said air blast on said container ends in said axial interval producing a force sufficient to overcome the friction between said reversed container ends and said non-reversed container ends but insufficient to overcome the support provided to said non-reversed container ends by adjacent nested container ends, thereby ejected said reversed container ends from said axially aligned group.

22. The system of claim 21, wherein said axial dimension of said interval is greater than the axial dimension of four said container ends nested together.

23. The system of claim 21, wherein said support member comprises a generally tubular conduit having a wall defining a bore, an ejection slot and an air passage;

said bore passing longitudinally through said conduit and comprising a portion of said path of movement for said axially aligned group;

said ejection slot formed through said wall and transversely crossing across a portion of said bore, having a first edge axially positioned at the upstream end of the interval and a second edge axially positioned at the downstream end of the interval, and being positioned, when viewed in cross section along said bore, on the side of said wall opposite said air nozzle, said ejection slot accommodating the passage therethrough of at least one said container end moving from said bore in the preferred lateral direction; and said air passage formed through said wall between said nozzle and said bore allowing an air blast exiting said nozzle to pass therethrough into said bore.

24. The system of claim 23, wherein said ejection slot is sized to allow passage of more than one nested container end simultaneously therethrough.

25. The system of claim 23, wherein said ejection slot is adapted to allow lateral passage of a sub-group of container ends therethrough.

26. The system of claim 21, wherein a sensor sensing fluctuations in a localized electric field is used for detecting said peripheral gap at said predetermined position.

27. The system of claim 21, wherein a sensor sensing fluctuations in a localized magnetic field is used for detecting said peripheral gap at said predetermined position.

28. The system of claim 21, wherein an optical sensor is used for detecting said peripheral gap at said predetermined position.

29. The system of claim 21, wherein a mechanical sensor is used for detecting said peripheral gap at said predetermined position.

30. The system of claim 21, further comprising:

an ejected end sensor positioned adjacent an expected path for said container ends ejected from said system for detecting whether or not a container end has been ejected from said axially aligned group and providing a corresponding signal to said control unit.

31. The system of claim 30, wherein an optical sensor is used for said ejected end sensor.

32. The system of claim 31, wherein said optical sensor includes a light source producing a light beam directed across the expected path of said ejected container end and a light receiver detecting said light beam and providing an end ejected control signal to said control unit upon interruption of said light beam by the passage of an ejected container end thereacross.

33. The system of claim 30, wherein said control unit, upon receiving an end ejected signal, actuates said air control valve to stop the flow of pressurized air from said air source to said nozzle.

34. A method for ejecting container ends having a reversed orientation from an axially aligned group of nested container ends being otherwise similar but having a non-reversed orientation, said axially aligned group moving axially along a path of movement in a direction of movement, the radial periphery of said axially aligned group forming a gap where the back surface of unlike-oriented container ends abut one another, said method comprising the steps of:

constraining said axially aligned group over a portion of said path of movement to prevent lateral movement of said container ends except when said container ends are in a predetermined axial interval within said portion, the movement of said container ends within said interval being externally unconstrained in a preferred lateral direction;

counting said container ends in said axially aligned group passing a first point located along said interval and upstream, with respect to said direction of movement, from said interval;

detecting a gap in the radial periphery of said axially aligned group passing a second point located along said interval at a predetermined distance upstream from said interval;

waiting, after a gap is detected passing said second point, until the number of container ends counted passing said first point since said gap passed said second point reaches a predetermined number; and directing a steam of air in the preferred lateral direction against said container ends in said axially aligned group within said interval;

whereby the impingement of the air stream on said container ends creates a lateral force which ejects those of said container ends which are not externally constrained and not nested with constrained container ends.

35. The method of claim 34, wherein a tubular open-ended conduit positioned along said path of movement is used for constraining said axially aligned group along said interval, said conduit defining a slot within said interval, said slot being sized to allow lateral passage of a container end therethrough.

36. The method of claim 35, wherein said slot is sized to allow lateral passage of more than one nested container end simultaneously therethrough.

37. The method of claim 35, wherein said slot has an axial width within the range of about ⅜ inches to about ⅝ inches.

38. The method of claim 34, wherein an optical sensor is used for counting said container ends passing said first point.

39. The method of claim 34, wherein a sensor sensing fluctuations in a localized electric field is used for detecting said gap in the radial periphery of said axially aligned group passing said second point.

40. The method of claim 34, further comprising the steps of:

detecting whether or not a container end has been ejected from said axially aligned group; and if a ejected container end is detected, then stopping said air stream directed against said axially aligned group;

otherwise, continuing to direct said air steam against said axially aligned group until a predetermined period of time has elapsed since the air stream was started.

41. The method of claim 40, wherein an optical sensor is used for detecting whether or not a container end has been ejected from said axially aligned group.

42. The method of claim 34, further comprising the steps of:

detecting a gap in the radial periphery of said axially aligned group passing a third point located along said path of movement downstream from said interval; and producing an alarm signal.

43. The method of claim 42, wherein a sensor sensing fluctuations in a localized electric field is used for detecting said gap in the radial periphery of said axially aligned group passing said third point.

44. A method for ejecting container ends having a reversed orientation from an axially aligned group of nested container ends being otherwise similar but having a non-reversed orientation, said axially aligned group moving axially along a path of movement in a direction of movement, the radial periphery of said axially aligned group forming a gap where the back surface of unlike-oriented container ends abut one another, said method comprising the steps of:

constraining said axially aligned group over a portion of said path of movement to prevent lateral movement of said container ends except when said container ends are in a predetermined axial interval within said portion, the movement of said container ends within said interval being externally unconstrained in a preferred lateral direction;

detecting a gap in the radial periphery of said axially aligned group when said gap is at a predetermined position corresponding to a reversed container end being located within said axial interval; and directing a steam of air in the preferred lateral direction against said container ends in said axially aligned group within said interval;

whereby the impingement of the air stream on said container ends creates a lateral force which ejects those of said container ends which are not externally constrained and not nested with constrained container ends.

45. The method of claim 44, further comprising the steps of:

detecting whether or not a container end has been ejected from said axially aligned group; and if a ejected container end is detected, then stopping said air stream directed against said axially aligned group;

otherwise, continuing to direct said air steam against said axially aligned group until a predetermined period of time has elapsed since the air stream was started.

* * * * *

UNITED STATES PATENT AND TRADEMARK OFFICE

CERTIFICATE OF CORRECTION

PATENT NO. : 6,062,395

DATED : May 16, 2000

INVENTOR(S) : Oravetz et al.

It is certified that error appears in the above-identified patent and that said Letters Patent is hereby corrected as shown below:

| | |
|---|---|
| Column 2, line 27 | Delete "A" |
| Column 9, line 49 | Delete "is" |
| Column 19, line 26 | Delete "steam"<br>Insert --stream-- |
| Column 19, line 56 | Delete "a"<br>Insert --an-- |
| Column 20, line 1 | Delete "steam"<br>Insert --stream-- |
| Column 20, line 38 | Delete "steam"<br>Insert --stream-- |
| Column 20, line 50 | Delete "a"<br>Insert --an-- |
| Column 20, line 52 | Delete "steam"<br>Insert --stream-- |

Signed and Sealed this

Seventeenth Day of April, 2001

*Attest:*

Nicholas P. Godici

NICHOLAS P. GODICI

*Attesting Officer*

*Acting Director of the United States Patent and Trademark Office*